US008220567B2

(12) United States Patent
Scott et al.

(10) Patent No.: US 8,220,567 B2
(45) Date of Patent: Jul. 17, 2012

(54) IMPREGNATED BIT WITH IMPROVED GRIT PROTRUSION

(75) Inventors: Dan E. Scott, Montgomery, TX (US); Wesley D. Fuller, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 12/403,734

(22) Filed: Mar. 13, 2009

(65) Prior Publication Data

US 2010/0230174 A1 Sep. 16, 2010

(51) Int. Cl.
*E21B 10/46* (2006.01)

(52) U.S. Cl. ..... 175/434; 175/426

(58) Field of Classification Search ..... 175/434, 175/426

See application file for complete search history.

(56) References Cited

U.S. PATENT DOCUMENTS 3,106,973 A 10/1963 Christensen
3,650,714 A * 3/1972 Farkas ..... 51/295
4,128,136 A 12/1978 Generoux
4,234,048 A 11/1980 Rowley
4,797,241 A * 1/1989 Peterson et al. ..... 264/122
4,940,180 A * 7/1990 Martell ..... 228/122.1
5,024,680 A * 6/1991 Chen et al. ..... 51/295
5,049,164 A * 9/1991 Horton et al. ..... 51/295
5,126,207 A * 6/1992 Chen et al. ..... 428/408
5,143,523 A * 9/1992 Matarrese ..... 51/293
5,224,969 A * 7/1993 Chen et al. ..... 51/295
5,230,718 A * 7/1993 Oki et al. ..... 51/295
5,232,469 A * 8/1993 McEachron et al. ..... 51/295
5,348,108 A * 9/1994 Scott et al. ..... 175/432
5,355,750 A * 10/1994 Scott et al. ..... 76/108.2
5,413,772 A * 5/1995 Pinneo ..... 423/446
5,755,299 A * 5/1998 Langford et al. ..... 175/375
6,009,962 A * 1/2000 Beaton ..... 175/426
6,095,265 A 8/2000 Alsup
6,238,280 B1 * 5/2001 Ritt et al. ..... 451/540
6,458,471 B2 10/2002 Lovato et al.
6,510,906 B1 1/2003 Richert et al.
6,742,611 B1 6/2004 Illerhaus et al.
6,843,333 B2 * 1/2005 Richert et al. ..... 175/379
7,469,757 B2 * 12/2008 Azar et al. ..... 175/432
7,497,280 B2 * 3/2009 Brackin et al. ..... 175/374
7,597,159 B2 * 10/2009 Overstreet ..... 175/374
7,703,555 B2 * 4/2010 Overstreet ..... 175/425
7,810,588 B2 * 10/2010 McClain et al. ..... 175/434
7,866,419 B2 * 1/2011 Lockwood ..... 175/426
2008/0017421 A1 * 1/2008 Lockwood ..... 175/434

(Continued)

OTHER PUBLICATIONS

Aliko, Enis, et al., "New-Generation PCD Bits Allow Drilling at Record Rates of Penetration and Increased Durability in Challenging Algerian Applications", IADC/SPE 112733, Mar. 2008, 1-10.

(Continued)

*Primary Examiner* — Jennifer H Gay
(74) *Attorney, Agent, or Firm* — Steve Rosenblatt

(57) ABSTRACT

A diamond impregnated drill bit features layered encapsulation of the diamond grit where the innermost layer is hardest or most abrasion resistant while succeeding layers are generally softer and less wear resistant. This can be accomplished by manipulating several variables in the encapsulation layers such as particle size or hard particle concentration. The outer layers can have added binder to make them softer. The encapsulated grit can be sintered or pre-sintered to make it less friable when handled.

17 Claims, 3 Drawing Sheets

U.S. PATENT DOCUMENTS

| | | | | |
|---|---|---|---|---|
| 2008/0202821 | A1* | 8/2008 | McClain et al. | 175/434 |
| 2008/0282618 | A1* | 11/2008 | Lockwood | 51/295 |
| 2008/0314646 | A1* | 12/2008 | Lockwood et al. | 175/374 |
| 2009/0120008 | A1* | 5/2009 | Lockwood et al. | 51/295 |
| 2010/0038147 | A1* | 2/2010 | Lockstedt et al. | 175/426 |
| 2010/0122853 | A1* | 5/2010 | Scott et al. | 175/434 |
| 2010/0193254 | A1* | 8/2010 | Lind et al. | 175/393 |
| 2010/0230173 | A1* | 9/2010 | Xia et al. | 175/374 |
| 2010/0230174 | A1* | 9/2010 | Scott et al. | 175/379 |

OTHER PUBLICATIONS

Judzis, Arnis, et al., "Optimization of Deep Drilling Performance: Benchmark Testing Drives ROP Improvements for Bits and Drilling Fluids", SPE/IADC 105885, Feb. 2007, 1-12.

Foucault, Hubert, et al., "Latest PCD Technology and Optimization Process Enable Replacement of Multiple Impregnated and Roller Cone Bits with One PDC Bit Run", SPE 128562, Feb. 2010, 1-11.

* cited by examiner

IMPREGNATED BIT WITH IMPROVED GRIT PROTRUSION

FIELD OF THE INVENTION

The field of the invention is diamond impregnated bits and more particularly the manner in which the diamonds are encapsulated for fixation in the bit matrix.

BACKGROUND OF THE INVENTION

So-called "impregnated" drag bits have been used conventionally for drilling rock formations that are hard, abrasive, or both. More particularly, conventional earth boring drag bits with diamond-impregnated cutting structures, commonly termed "segments," or, alternatively, discrete diamond-impregnated cutting structures have been employed to bore through very hard and abrasive formations, such as basalt, dolomite, and hard sandstone. These conventional impregnated drag bits typically employ a cutting face comprising a diamond impregnated material, which refers to an abrasive particle or material, such as natural or synthetic diamond grit, uniformly dispersed within a matrix of surrounding material. As a conventional impregnated drag bit drills, the matrix wears to expose the abrasive particles, the abrasive particles also wear, and worn abrasive particles may be lost and new abrasive particles, which were previously surrounded by matrix material, may be exposed.

In fact, many conventional diamond impregnated segments may be designed to release, or "shed," such diamonds or grit in a controlled manner during use of the drag bit. As a layer of diamonds or grit is shed from the face, underlying diamonds are exposed as abrasive cuttings and the diamonds that have been shed from the drag bit wear away the exposed continuous phase of the segment in which the interior diamonds are substantially uniformly dispersed until the entire diamond-impregnated portion of the bit has been consumed. Thus, drag bits with diamond-impregnated segments may maintain a substantially constant boring rate or rate of penetration, assuming a homogeneous formation, as long as diamonds remain exposed on such segments.

Regarding conventional abrasive-impregnated cutting structures, the abrasive material with which the continuous matrix material is impregnated preferably comprises a hard, abrasive and abrasion-resistant particulate material, and most preferably a super-abrasive material, such as natural diamond, synthetic diamond, or cubic boron nitride.

The impregnated segment may include more than one type of abrasive material, as well as one or more sizes or quality grades of abrasive material particles. In conventional abrasive-impregnated cutting structures, the abrasive is substantially homogeneously distributed (i.e., not segregated) within the continuous matrix material. The continuous matrix material may be chosen for wettability to the abrasive particles, mechanical properties, such as abrasion resistance, or both, and may comprise one or more of copper, a copper-based alloy, nickel, a nickel-based alloy, cobalt, a cobalt-based alloy, iron, an iron-based alloy, silver, or a silver-based alloy.

Two general approaches are conventionally employed to fabricate drag bits having abrasive-impregnated cutting structures.

In a first approach, an abrasive-impregnated cutting structure may be cast integrally with the body of a drag bit, as by low-pressure infiltration. For instance, one conventional abrasive-impregnated cutting structure configuration includes placing abrasive material into a mold (usually mixed with a molten wax) as by hand-packing, as known in the art.

Subsequently, the mold may be filled with other powders and a steel core and the entire assembly heated sufficiently to allow the infiltrant, such as a molten alloy of copper or tin to infiltrate the powders and abrasive material. The result, upon the infiltrant cooling and solidifying, is a bit body, which has abrasive-impregnated cutting structures bonded thereto by the continuous matrix of the infiltrant.

In a second approach, the abrasive-impregnated cutting structures may be preformed or fabricated separately, as in hot isostatic pressure infiltration, and then brazed or welded to the body of a drag bit. Thus, conventional abrasive-impregnated cutting structures may be formed as so-called "segments" by hot-pressing, infiltration, or the like, which may be brazed or otherwise held into a bit body after the bit body is fabricated. Such a configuration allows for the bit body to include infiltrants with higher melting temperatures and to avoid damage to the abrasive material within the abrasive-impregnated cutting structures that would occur if subjected to the higher temperatures.

In a third process preformed segments are placed in the mold and then matrix added and infiltrated as in example one above.

In a fourth process encapsulated grit is dispersed within the matrix, etc. and then cast as example one mentioned above.

As known in the art, diamond impregnated segments of drag bits may be typically secured to the boring end, which is typically termed the "face," of the bit body of the drag bit, oriented in a generally radial fashion. Impregnated segments may also be disposed concentrically or spirally over the face of the drag bit. As the drag bit gradually grinds through a very hard and abrasive formation, the outermost layer of the impregnated segments containing abrasive particles wear and may fracture, as described above. For instance, U.S. Pat. No. 4,234,048 (the "'048 patent"), which issued to David S. Rowley on Nov. 18, 1980, discloses an exemplary drag bit that bears diamond-impregnated segments on the crown thereof. Typically, the impregnated segments of such drag bits are C-shaped or hemispherically shaped, somewhat flat, and arranged somewhat radially around the crown of the drag bit. Each impregnated segment typically extends from the inner cone of the drag bit, radially outwardly therefrom and up the bit face to the gage. The impregnated segments may be attached directly to the drag bit during infiltration or partially disposed within a slot or channel formed into the crown and secured to the drag bit by brazing.

Alternatively, conventional discrete, post-like cutting structures are disclosed in U.S. Pat. Nos. 6,458,471 and 6,510,906, both of which are assigned to the assignee of the present invention and each of the disclosures of which are incorporated, in their entirety, by reference herein.

U.S. Pat. No. 3,106,973 issued to Christensen on Oct. 15, 1963, discloses a drag bit provided with circumferentially and radially grooves having cutter blades secured therein. The cutter blades have diamond impregnated sections formed of a matrix of preselected materials.

U.S. Pat. No. 4,128,136 issued to Generoux on Dec. 5, 1978, discloses a diamond coring bit having an annular crown and inner and outer concentric side surfaces. The inner concentric side surface of the crown defines a hollow core in the annular crown of the bit for accommodating a core sample of a subterranean formation. The annular crown is formed from a plurality of radially oriented composite segments impregnated with diamonds radially and circumferentially spaced apart from each other by less abrasive spacer materials.

U.S. Pat. No. 6,095,265 to Alsup discloses an adaptive matrix including two or more different abrasive compositions in alternating ribs or in staggered alternating zones of each rib to establish different diamond exposure in specified areas of the bit face. Alsup further discloses that the abrasive compositions for adaptive matrix bits contain diamond and/or other super-hard materials within a supporting material. The supporting material may include a particulate phase of tungsten carbide and/or other hard compounds, and a metallic binder phase of copper or other primarily non-ferrous alloys. Alsup discloses that the properties of the resulting metal-matrix composite material depend on both the percentage of each component and the processing that combines the components. Further, Alsup discloses that the size and type of the diamonds, carbide particles, binder alloy or other components can also be used to effect changes in the overall abrasive or erosive wear properties of the abrasive composition. Additionally, such adjacent "hard" and "soft" ribs may purportedly facilitate fluid cleaning in and around the ribs.

U.S. Pat. No. 6,458,471 to Lovato et al., assigned to the assignee of the present invention and the disclosure of which is incorporated herein its entirety by reference thereto, discloses cutting elements including an abrasive-impregnated cutting structure having an associated support member, wherein the support member is securable to an earth boring rotary-type drag bit body and provides mechanical support to the cutting structure.

U.S. Pat. No. 6,742,611 to Illerhaus et al., assigned to the assignee of the present invention and the disclosure of which is incorporated herein its entirety by reference thereto, discloses a first cutting element segment formed of a continuous-phase solid matrix material impregnated with at least one particulate super abrasive material, the first cutting element segment juxtapositioned with at least one second cutting element segment formed of a continuous-phase solid matrix material to form a laminated cutting element. Preferably, the at least one second cutting element segment is essentially devoid of impregnated super abrasive or abrasive particles. Alternatively, the at least one second cutting element segment can be impregnated with a preselected, secondary, particulate super abrasive material that results in the at least one second segment being less abrasive and less wear resistant than the at least one first abrasive segment.

While the above-discussed conventional abrasive-impregnated cutting structures and drag bits may perform as intended, it may be appreciated that improved abrasive-impregnated cutting structures and drag bits would be desirable. Further, it would be desirable to improve abrasive-impregnated cutting structures that exhibit selectable wear characteristics.

FIG. 1 is a section view through a diamond impregnated bit that illustrates a new condition of diamonds 10 encapsulated by a coating 12 and disposed in a matrix that includes a binder 14 that further includes hard particles such as carbide 16. In operation the matrix 14 wears away as does the encapsulating material 12. As shown in FIG. 2 at 18 the encapsulating material 12 wears faster than the matrix 14 ahead of the diamond 10 that now has one or more facets 20 on the leading face in the cutting direction exposed. FIG. 3 is a close up of the view in FIG. 2 and graphically illustrates the problem. The encapsulating material 12 is generally less wear resistant than the matrix 14 with the distributed carbide material 16 and as a result begins to form a deepening valley 22 caused by abrasive wear with the formation being drilled. The effect on the trailing portion of the diamond 10 such as near surface 24 is less pronounced but still some of the encapsulating material 12 has also worn off as surface 24 becomes exposed to the formation. On the trailing side of diamond 10 in the direction of rotation a wear pattern known as "comet tails" 26 because of its appearance is evident and better seen from a bottom view of a bit face shown in FIG. 4. As shown in FIG. 3 because of the close diamond 10 spacing, the comet tail from one diamond 10 can contribute to the removal of the encapsulating material 28 from adjacent diamond 10' that is behind it measured in the direction of bit rotation indicated by arrow 30.

What is illustrated in the above FIGS. is that the encapsulation 12 for the diamonds 10 which is generally less abrasion and impact resistant than the matrix 14 that surrounds it, progressively undermines the structural support for the diamond 10 in the matrix 14. While the diamonds 10 are far more wear resistant and durable than the matrix 14 their ability to drill hard formations is limited to the physical support the diamonds 10 have in the matrix 14. If such structural support for the diamonds 10 is undermined by removal of the surrounding encapsulating material 12 then the impact with the formation simply breaks the diamond particle 10 with its remaining coating 12 right out of the matrix 14 prematurely. It should be noted that the desired wear process is for enough matrix 14 to wear so that at some point before the diamond 10 is fully consumed it is dislodged to allow other diamonds 10 deeper in the matrix 14 to come to the face and take over cutting through the hard formation. The problem is in optimizing the duration of time that the diamond 10 is retained in the matrix 14 so that it can support an optimum rate of penetration. Another issue is optimizing the diamond protrusion for increased effective depth of cut (DOC) and increased rate of penetration (ROP).

In the past diamond grit has been encapsulated in a single layer of tungsten carbide and binders. The carbide layer was an agglomerate of small WC particles which are agglomerated to the diamond grit in a rolling or tumbling process. The added organic binder is burned out during this process. The particle size of the agglomerate could be uniform or varied but it forms a single layer of a desired thickness. The shortcomings of such a single layer encapsulation have been discussed above and are the focus of the issue addressed by the present invention.

The present invention addresses this issue with a preferred design that features application of multiple layers that have either discrete or blended boundaries on the diamond that get progressively softer and less resistant to abrasion as they are applied to the diamond. Optionally, the matrix can be made somewhat softer by a reduction if not total elimination of added carbide particles in the matrix. It has been observed that bits are frequently pulled for replacement before the diamonds have been fully consumed. What can happen is that the rate of penetration falls off when enough encapsulated diamonds come off leaving only the matrix with carbide particles to make further progress into the formation while there are still other diamonds that have been exposed for further progress in drilling. The thinking is to make the matrix somewhat softer while using the layered encapsulation to get more run time with the encapsulated diamonds before they are knocked off the bit will improve the total footage and rate to the point of bit replacement. Those skilled in the art will appreciate that the description of the preferred embodiment with the associated figures will further point out other aspects of the invention while recognizing that the full scope of the invention is to be found in the appended claims.

SUMMARY OF THE INVENTION

A diamond impregnated drill bit features layered encapsulation of the diamond grit where the innermost layer is hardest or most abrasion resistant while succeeding layers are generally softer. This can be accomplished by manipulating several variables in the encapsulation layers such as particle size or hard particle concentration. The outer layers can have added binder to make them softer. The encapsulated grit can be sintered or pre-sintered to make it less friable when handled. As a result the encapsulated diamonds are retained in the matrix longer and develop a preferred wear pattern and protrusion to improve bit longevity and penetration rates. The matrix can also have a reduced concentration of hard particles or none at all to make it softer to allow more encapsulated diamonds to become exposed for drilling during a typical life cycle of a bit before change out.

DETAILED DESCRIPTION OF THE PREFERRED EMBODIMENT

Figure 1:
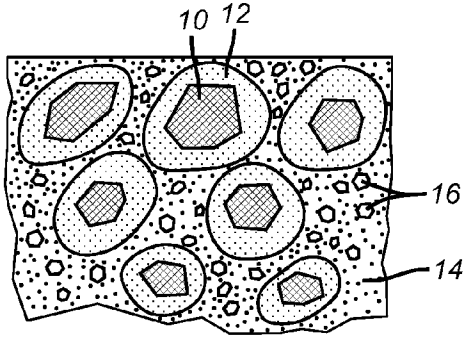
(PRIOR ART) FIG. 1
FIG. 1 is a section view through a prior art impregnated drag bit before drilling begins.
Figure 2:
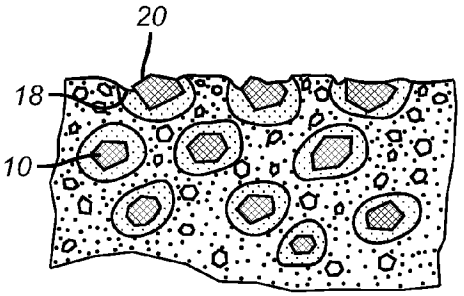
(PRIOR ART) FIG. 2
FIG. 2 is the view of FIG. 1 showing wear during drilling.
Figure 3:
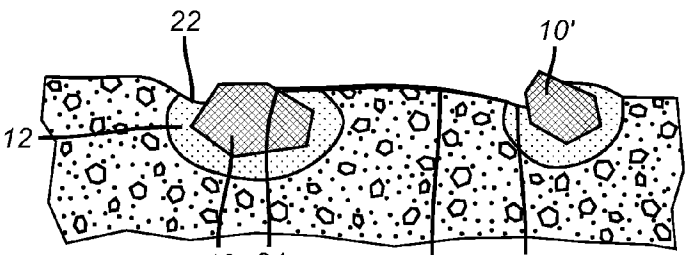
(PRIOR ART) FIG. 3
FIG. 3 is an enlarged view of FIG. 2.
Figure 4:
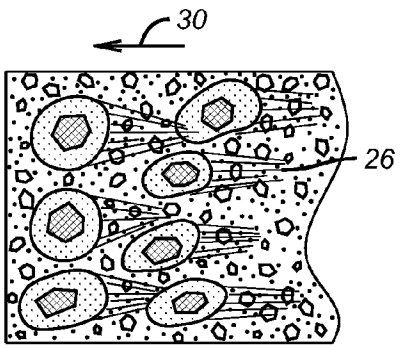
(PRIOR ART) FIG. 4
FIG. 4 is a bottom view of the bit of FIG. 1.
Figure 6:
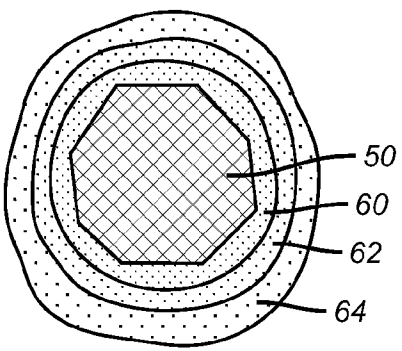
FIG. 6 is a close up of an encapsulated diamond showing the layers around it.
Figure 5:
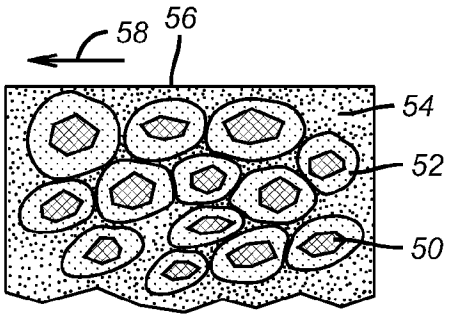
FIG. 5 is a section view of an impregnated drag bit of the present invention before use.

FIG. 5 illustrates an array of diamonds that can also be referred to as diamond grit or sintered pellet 50 that are each covered by multiple layers of encapsulation 52 in a matrix with binder 54. The assembly rotates in the direction of arrow 58 and in the FIG. 5 condition the initial cutting surface 56 has yet to drill. FIG. 6 shows a close up view of a single diamond 50 surrounded by encapsulating layers 60, 62 and 64. Although three layers are shown any number of layers from two on up can be used without departing from the invention. While the layers can be discrete as illustrated in FIG. 5 the layers can blend into each other so that the characteristics change but discrete borders among layers are not necessarily there or easily noticed. The layer thickness can also vary, in situations where discrete layers can be discerned. The layers get softer from 60 to 64. Preferably each layer completely covers the layer under it and the innermost layer fully covers the diamond 50. The goal is to have progressively less abrasion or wear resistance in the layers as they get further away from the diamond 50. The ways the decreasing resistance to wear can be accomplished are varied and include particle size distribution of hard materials, declining particle density in the outer layers while varying particle size or keeping particle sizes the same or in a narrow size range. Related to these concepts is increasing the binder content of the outer layers which can have a lower density of hard materials or varying combinations of particle size and binder percentage. The material selection for individual layers can also be varied with the succeeding layers as another variable that can be controlled to get the variations from hard to softer in the layers going away from the diamond 50. As an example of the variation envisioned, layers 60, 62 and 64 can have tungsten carbide particles in each layer with a respective particle size distribution of 5 to 20 microns in a three layer system on top of an innermost tungsten carbide layer that would be the most wear resistant. From there going away from the diamond 50 the next layer can be less than 5 micron particles, followed by about 5-10 microns for the next layer and 15-20 for the next layer. The particle density variation among the layers can be 80% to 94% going away from the diamond 50 and excluding the innermost and thin protective layer initially deposited but not necessarily remaining in place during the manufacturing process. Various materials can be selected for the encapsulation layers apart from tungsten carbide such as any refractory metal carbide or ceramics.

The tungsten coating immediately adjacent the diamond 50 should not confused as being part of the layers of encapsulation around the diamond 50. With the current encapsulation methods the innermost tungsten coating adjacent the diamond 50 is being dissolved or breaking down during infiltration/manufacturing process because the diamonds 50 are pre-sintered which allows the binder in the matrix 54 to infiltrate into the diamond which also causes partial dissolution of the encapsulation coating.

It is preferred to have a sintered diamond 50 which is an agglomeration of hard particles but with the multiple layers. The tungsten coating or other coatings on the diamond 50 is optional and the encapsulation layers of progressively softer characteristics can be applied to the diamond 50 directly. The ideal encapsulation thickness for all layers would be 250 microns or less. The encapsulation thickness can be used to adjust the diamond concentration in the matrix; the larger the encapsulated pellet, the lower the diamond concentration. This agglomeration of WC particles around the diamond grit, with one layer is typical of the prior art. The known single encapsulated layer wears at a uniform rate, awhile the bi or multi layered encapsulated grit of the present invention wears in a non uniform or stepped fashion as shown in FIGS. 5-12.

Figure 8:
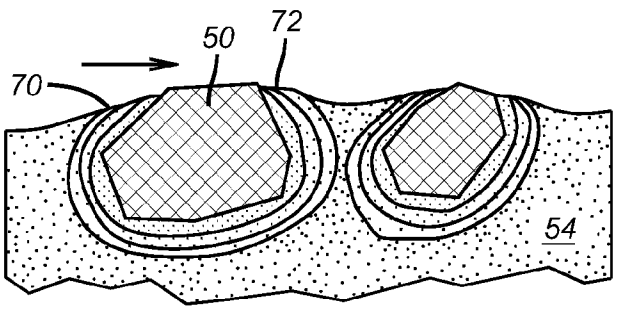
FIG. 8 is a close up of the view of FIG. 7 showing no hard particles in the matrix.
Figure 7:
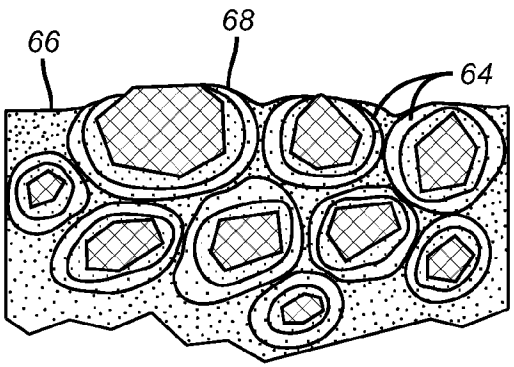
FIG. 7 shows the onset of wear of the bit of FIG. 5.

FIG. 7 shows the onset of wear through use showing mild wear ahead of the diamond 50 at 66 and behind at 68. The face in contact with the formation has ground off all the layers but for a substantial portion of the perimeter the various layers are still intact and in the cutting row shown in FIG. 7 the outer layers 64 can abut between at least some of the diamonds 50. FIG. 8 shows a close up of FIG. 7 where the matrix 54 has no hard particles. In the past, there were issues with the diamonds getting dislodged prematurely leaving the drilling task to the hard particles in the matrix. What experienced showed when bits were removed for wear leading to a reduction in the rate of penetration that caused the need to replace, was that there still was a substantial number of encapsulated diamonds embedded in the matrix that had yet come to the edge of the bit to do any drilling. The objective of reducing hard particles in the matrix goes with the multi-layered encapsulation of the present invention. The idea is to make more of the encapsulated diamonds remain longer in position where they are supported by the matrix to continue penetration into the rock formation. At the same time reducing the binder strength somewhat by a lower density of solid particles or no solid particles at all will speed up exposure to drill of the next encapsulated diamond after one that has drilled longer than in the past is ultimately dislodged. For that reason more of the capacity of a bit can be utilized by the time it is replaced and more footage can be drilled as the diamonds are exposed longer and with a larger surface area for drilling and the interval of change to another diamond after the one drilling below it is knocked out is also shorter. This goes in a different direction than the prevailing thinking of making the matrix stronger with hardened particles so that some rate of penetration can be made when it is just matrix exposed to the formation until another encapsulated diamond is exposed.

Figure 10:
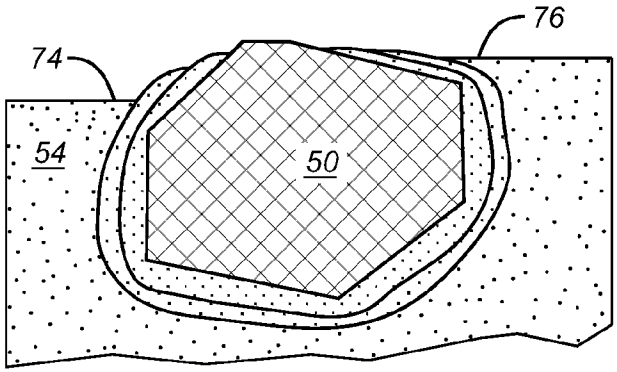
FIG. 10 is the view of FIG. 9 showing the wear pattern.
Figure 9:
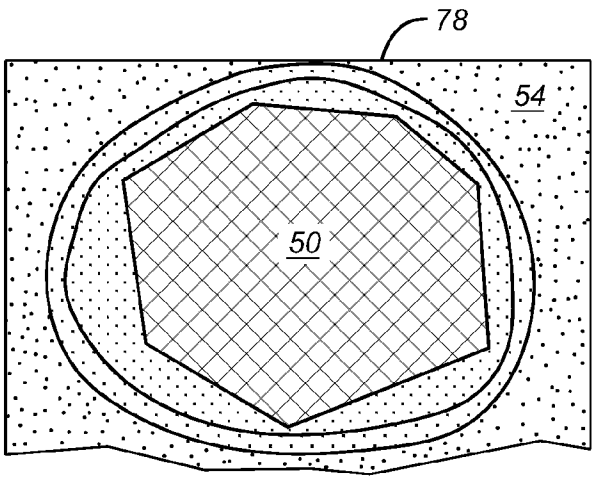
FIG. 9 is a close up of a single diamond of the bit of FIG. 5 shown before use.

In any event, FIG. 8 illustrates the onset of drilling with a portion of the diamond 50 exposed. There is little to no undercutting the encapsulating layers at 70 and 72. FIG. 10 shows this in close up indicating that on the leading end 74 some of the matrix 54 has be worn away while the trailing end 76 exhibits less wear. Here there are two layers shown but alternatives with more encapsulating layers are possible. Note that the slow removal of the encapsulating layers allows firm support for the diamond 50 while portions of it are exposed for cutting into the formation. FIG. 9 is a starting condition illustrating the encapsulated diamond 50 extending to the edge 78 of the matrix 54.

Figure 12:
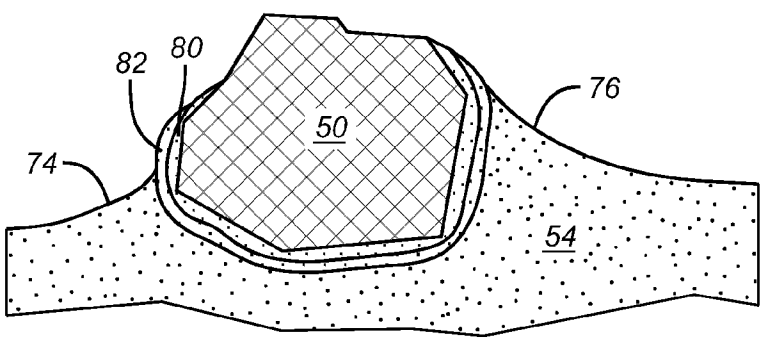
FIG. 12 is the view of FIG. 11 after additional wear.
Figure 11:
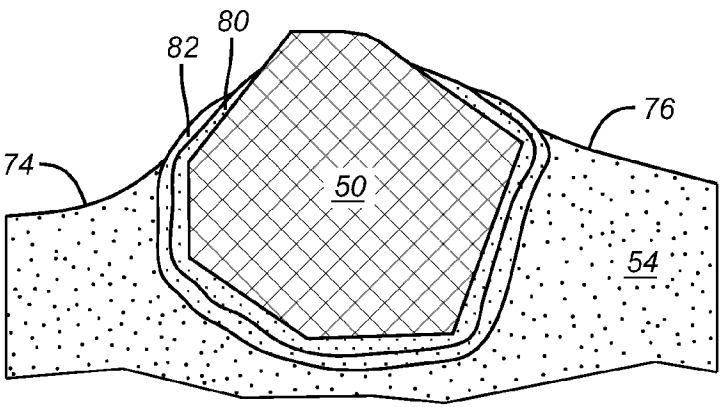
FIG. 11 is the view of FIG. 10 after additional wear.

FIGS. 11 and 12 illustrate further wear of the two encapsulating layers 80 and 82 more severely at the leading side 74 than the trailing side 76. The matrix 54 takes on a pyramid shape as a greater percentage of the diamond 50 extends beyond the matrix 54 until the time that insufficient support for the diamond 50 is provided by the remaining contact between the encapsulating layer 82 or 80 and the diamond 50 is dislodged. However, it is the presence of the encapsulation layers that get stronger as they are progressively exposed that helps to retain the diamond 50 longer than the prior single encapsulation layer design.

The above description is illustrative of the preferred embodiment and many modifications may be made by those skilled in the art without departing from the invention whose scope is to be determined from the literal and equivalent scope of the claims below:

We claim:

1. An abrasive-impregnated cutting structure for use on a rotary drag bit for drilling a subterranean formation, comprising:

a plurality of abrasive particles in a matrix;

a plurality of layers on said particles wherein, in a direction moving away from said abrasive particles the layer concentration of hard particles progressively decreases for all said layers; and wherein adjacent layers have discrete boundaries.

2. The structure of claim 1, wherein:

the thickness of said layers combined is less than about 250 microns.

3. The structure of claim 1, wherein:

said layers comprise a binder and a hard material and a first layer further from an abrasive particle that said first layer encapsulates has a lower concentration of hard material than a second layer closer to said abrasive particle.

4. The structure of claim 3, wherein:

the particle size of the hard material in said first and second layers is the same.

5. The structure of claim 3, wherein:

the particle size of the hard material in said first and second layers is different.

6. The structure of claim 5, wherein:

the particle size of said hard material in said first layer is larger than the particle size of said hard material in said second layer.

7. The structure of claim 3, wherein:

said hard material concentration variation between said first and second layers is at least 80%.

8. The structure of claim 1, wherein:

said layers comprise a binder and a hard material and a first layer further from an abrasive particle that said first layer encapsulates has substantially the same concentration of hard material as a second layer closer to said abrasive particle;

the particle size of said hard material in said first and second layers is different.

9. The structure of claim 8, wherein:

the particle size range of said hard materials is about 5-20 microns.

10. The structure of claim 9, wherein:

the aggregate thickness of said layers is less than 250 microns.

11. The structure of claim 10, wherein:

the concentration of hard particles in the matrix varies with said layers to give them different wear rates.

12. The structure of claim 1, wherein:

said layers comprise a binder and a hard material and said hard material comprises at least one selected from a group consisting of tungsten carbide, refractory metal carbide or a ceramic.

13. The structure of claim 1, further comprising:

an innermost coating of tungsten carbide covering at least a portion of said abrasive particles and in direct contact therewith;

said layers encapsulating said innermost coating.

14. The structure of claim 1, wherein:

said layers wear at non-uniform rates.

15. The structure of claim 1, wherein:

said layers retain said abrasive particles to said matrix as wear from bit rotation progressively removes at least a portion of an outermost said layer.

16. The structure of claim 1, wherein:

said matrix has no hard particles.

17. The structure of claim 1, wherein:

the concentration of hard particles in the matrix varies with said layers to give them different wear rates.

* * * * *